US006145284A

United States Patent [19]

Eggers

[11] Patent Number: 6,145,284

[45] Date of Patent: Nov. 14, 2000

[54] FILLING MACHINE FOR THERMOPLASTIC CUPS

[76] Inventor: Thies Eggers, Reichenhain 21, D-51789 Lindlar, Germany

[21] Appl. No.: 09/241,919

[22] Filed: Feb. 2, 1999

[51] Int. Cl.[7] ..... B65B 47/00

[52] U.S. Cl. ..... 53/559; 141/129; 141/238; 141/242

[58] Field of Search ..... 141/129, 237, 141/238, 242, 243, 309, 319; 53/559

[56] References Cited

U.S. PATENT DOCUMENTS

| | | | |
|---|---|---|---|
| 3,244,779 | 4/1966 | Levey et al. | 141/237 |
| 3,497,111 | 2/1970 | Savage | 222/146 |
| 4,730,648 | 3/1988 | Walter | 141/91 |

FOREIGN PATENT DOCUMENTS

| | | | |
|---|---|---|---|
| 3817418 | 9/1989 | Germany | B65B 3/12 |
| 3943149 | 1/1991 | Germany | B65B 3/32 |
| 4025714 | 2/1992 | Germany . | |
| 9014578 | 11/1990 | WIPO . | |

*Primary Examiner*—Peter Vo
*Assistant Examiner*—Christopher R Harmon
*Attorney, Agent, or Firm*—Edwin D. Schindler

[57] ABSTRACT

A filling machine for thermoplastic cups, with a cyclically operating conveying section which takes over a cup sheet web with thermoformed cups from a thermoforming station, there being provided, for the simultaneous filling of a batch of cups, for each cup of the batch, a filling unit with a filling cylinder and a filling pipe for a pasty filling product, the filling cylinder containing a filling piston on the product side. The technical problem is to provide a filling machine which is easily adjustable in terms of volume, works without a sucking action, and is easy to clean and sterilize. An air piston (31) is connected, on the drive side, to the filling piston (24) by a piston rod (40) and the filling cylinder (23) is closed off above the air piston (31) by a cylinder head (32) which is connected to a pressure compensation reservoir via a compensation pipe (35).

21 Claims, 2 Drawing Sheets

FILLING MACHINE FOR THERMOPLASTIC CUPS

BACKGROUND OF THE INVENTION

1. Technical Field of the Invention

The present invention relates to a filling machine for thermoplastic cups, having a cyclically operating conveying section, for processing a cup sheet with thermoformed cups from a thermoforming station for a simultaneous filling of a batch of cups.

The field of the invention is the online filling of thermoplastic cups with a pasty filling product. A pasty filling product is also taken to mean a liquid filling product such as a beverage preparation. Possible filling products are food preparations such as cottage cheese or other milk products, pudding, jam, beverages or the like.

2. Prior Art

A filling machine for thermoplastic cups is disclosed in Federal Republic of Germany patent application No. 40 25 714 A1.

SUMMARY OF THE INVENTION

The object of the invention is to provide a filling machine which is easily adjustable in terms of volume, works without a sucking action, and is easy to clean and sterilize.

The foregoing and related objects are achieved by the presently claimed invention for a filling machine for thermoplastic cups, which includes a cyclically operating conveying section for processing a cup sheet web with thermoformed cups from a thermoforming station for the simultaneous filing of a batch of cups. For each cup of the batch, a filling unit with a filling cylinder is provided, along with a filling pipe for a pasty filling product. The filling cylinder contains a filling piston on a product side, in which an air piston is connected, on a drive side, to the filling piston by a piston rod and in which the filling cylinder is closed off above the air piston by a cylinder head, which is connected to a pressure compensation reservoir via a compensation pipe.

The invention differs from the prior art in that the filling product is pressed into the filling cylinder and, as a result of the pressure in the pressure compensation reservoir, is forced out of the filling cylinder, the pressure in the pressure compensation reservoir being increased only slightly as the filling product is pressed in. The pressure depends on the viscosity of the filling product. A special drive for the filling piston is not necessary. Nor is a low-pressure action required to fill the filling cylinder with filling product. The air piston, which is separated from the filling piston, prevents the filling product from penetrating into the compensation space, so that the same is easy to sterilize and keep clean. The number of filling pistons can be adapted to the particular cup batch to be filled.

The cleaning operation is facilitated by virtue of the fact that the filling cylinder is designed as a stepped cylinder with a filling-side portion having the smaller diameter for the filling piston and a drive-side portion having a larger diameter for the air piston.

The unhindered flow of the cleaning agent is facilitated by virtue of the fact that a further portion, having the largest diameter, adjoins the portion of the filling cylinder and this further portion receives the air piston during the cleaning phase. For cleaning, the filling piston is displaced as far as it will go, to allow the cleaning agent to flow unhindered.

The adjustment of the filling volume is made possible by virtue of the fact that, on the drive side, a spindle is arranged on the axis of the filling cylinder, a stop ring for the piston rod being displaceable on said spindle for the purpose of adjusting the filling volume. Each filling piston can thus be continuously adjusted from a volume of 0 up to the maximum value. The maximum value, or maximum limitation, of the filling piston is defined by a stop ring abutting against a plate, as further explained and illustrated in the accompanying drawing figures. A zero volume for the filling piston exists, and is so defined, as when this piston is not being used. This is also important for premetering or other additional metering.

Guidance of the spindle at the end is achieved by virtue of the fact that the piston rod is of hollow design and can slide over the spindle.

The filling product is treated better by virtue of the fact that the filling piston bears with a sealing lip against the cylinder wall. The filling piston is safe to run dry. The filling product is prevented from accumulating on the piston.

The filling is controlled by virtue of the fact that a product conduit leading into a product chamber of filling cylinder can be shut off by a closing piston.

The filling of the thermoplastic cups takes place by virtue of the fact that a filling valve leading to the filling pipe is provided at an outlet of product chamber.

Any number of filling cylinders can be connected to a group conduit. The filling product is supplied under pressure in the group conduit. The pressure in the pressure compensation reservoir is about 0.5 bar. This pressure is adapted to the viscosity of the filling product. By pressing the filling product into the filling cylinder, the pressure in the pressure compensation reservoir changes only slightly, by about 0.05 bar. During operation, only negligible leakage losses occur, so that the compressed-air requirement is likewise negligible. The filling cylinder can be employed for premetering and for main metering.

BRIEF DESCRIPTION OF THE DRAWING FIGURES

An exemplary embodiment is explained with reference to the drawings, in which:

FIG. 1 is a schematic general view of a filling plant.

DETAILED DESCRIPTION OF THE DRAWING AND PREFERRED EMBODIMENTS

Figure 1:
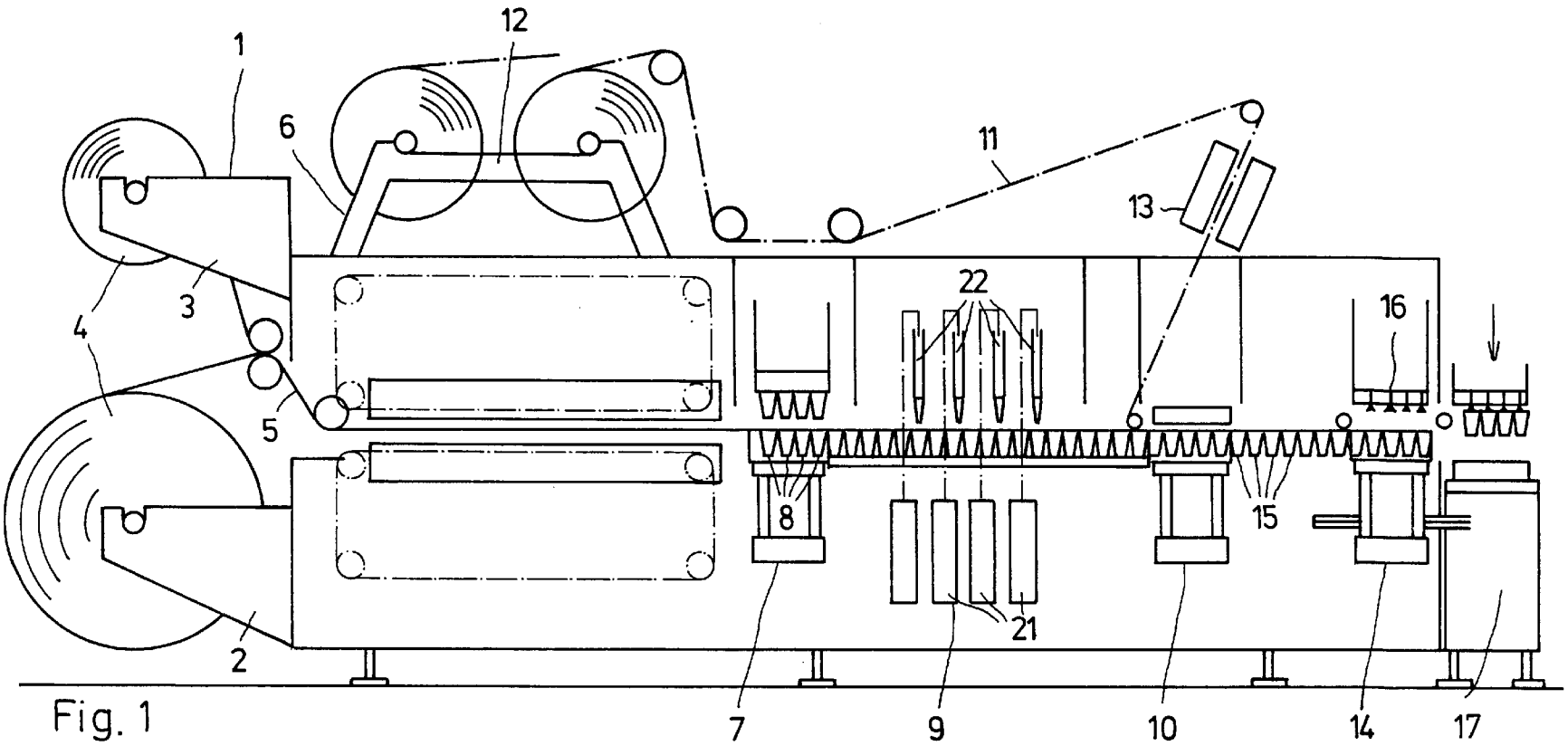
FIG. 1 shows a schematic view of a filling plant including the filling machine and FIG. 2 shows a schematic sectional representation of a filling unit.

The latter comprises the following essential processing stations:

- an alternating unwinder 1 with two unwinding receptacles 2, 3 for in each case one reel 4 of a thermoplastic sheet 5, the reels 4 being alternately unwound;
- a continuous conveying section with conveying rolls, holders and grippers, which are not shown or explained in more detail. The conveying section is set for a cyclical movement, so that in each case one batch of thermoplastic cups is moved into a working station;
- a heating station 6 for heating the thermoplastic sheet 5 to the thermoforming temperature;
- a thermoforming station 7 for forming a batch of thermoplastic cups 8;
- a filling machine 9 for filling the thermoplastic cups 8 with a pasty filling product. The filling machine 9 is equipped with filling units 21, arranged in groups and each having a filling pipe 22, for filling a batch of thermoplastic cups;

a sealing station 10 which is supplied with a lid foil web 11 from an alternating unwinder 12 via a heating station 13. The sealing station serves for heat sealing the lid foil onto the filled thermoplastic cups 15;

a punching station 14 for separating and singularizing the sealed thermoplastic cups 15 with a discharge gripper 16 which picks up the separated thermoplastic cups 20 batchwise and conveys them into a packing station 17, where the thermoplastic cups 20 are put into trays, cartons, pallets or other transport containers. The stations for final packaging are not shown.

Figure 2:
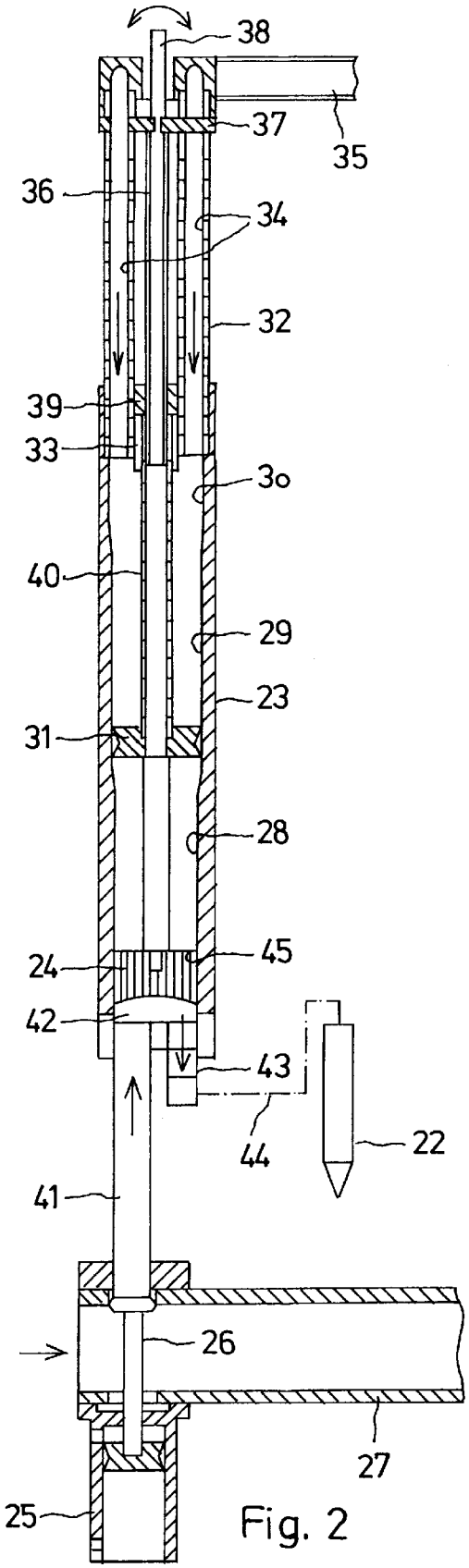

FIG. 2 shows a filling unit 21 with a filling cylinder 23 which receives a filling piston 24, the stroke of which is adjustable for the purpose of metering the filling product. The filling piston is bears with a sealing lip 45 against the internal wall of the cylinder, so that it works in such a manner as to be safe to run dry. Fouling of the filling piston by the filling product is thereby largely precluded. The filling cylinder 23 is connected, via a valve 25 with a closing piston 26, to a group conduit 27 which supplies a group of filling units.

The filling cylinder 23 is a stepped cylinder with a narrower portion 28 for the filling piston 24, a widened portion 29, offset via an outer step, for an air piston 31, and a portion 30 again offset via an outer step. The filling cylinder 23 is closed off by a cylinder head 32 which receives two air conduits 34 connected via a compensation pipe 35 to a pressure compensation reservoir (not shown) or a pressure compensation pipe.

Situated on the axis of the inner pipe 33 is a spindle 36 which is positioned in the axial direction in a plate 37 and has a head-side drive flange 38 for adjustment by hand, by means of a tool or by an actuating drive. The thread of the spindle 36 engages in the thread of a stop ring 39 which is guided between the air conduits 34 in such a manner as to be secure against rotation. The stop ring 39 serves as a stop for a piston rod 40 or an end sleeve 33 of the piston rod 40, which carries the filling piston 24 and the air piston 31. The piston rod 40 is hollow at least in the head region to allow the spindle 36 to penetrate into the piston rod 40.

A product conduit 41 leads from the group conduit via the closing piston 26 into a product chamber 42 of the filling cylinder 23. The product chamber 42 is, on the other hand, connected to a filling pipe 22 via a filling valve 43 and a filling conduit 44.

The mode of operation of the filling unit is as follows: in the pressure compensation reservoir there is normally a pressure of about 0.5 bar, which is adjusted in accordance with the viscosity of the filling product. To fill the filling cylinder 23, the closing piston 26 is opened, so that the filling product under pressure in the group conduit 27 enters the product chamber 42. The filling piston 24 is forced back. In the process, the pressure is increased slightly, by about 0.05 bar, to 0.55 bar as a result of the air in the pressure compensation reservoir being compressed. As soon as the set filling volume is reached, the end sleeve 33 of the piston rod 40 is abutting against the stop ring 39 and excites a sensor (not shown). The sensor signal results in the closure of the closing piston 26.

Once the batch of thermoplastic cups is positioned in the filling station, a signal is generated to open the filling valve 43. The filling product is filled into the thermoplastic cups in each case via the filling pipe 22 as a result of the pressure in the pressure compensation reservoir.

To clean the filling unit, the stop ring 39 of the spindle 36 is moved until it bears against the plate 37, thereby allowing the piston rod 40 to be pushed back a corresponding distance. This movement of the piston rod 40 takes place under the pressure of the cleaning agent on the filling piston 24. When the piston rod 40 abuts against the stop ring 39 bearing against the plate 37, the filling piston 24 is situated in the portion 23 and the air piston 31 in the portion 30, so that between the piston body and the internal wall of the cylinder in each case a gap remains free through which the cleaning agent can flow. The pressure compensation pipes serve as conduits for the cleaning agent. When the cleaning is finished, the stop ring 39 of the spindle 36 is in each case reset to the desired filling volume.

What is claimed is:

1. A filling machine for thermoplastic cups, comprising a cyclically operating conveying section for accepting a cup sheet web with thermoformed cups from a thermoforming station, for simultaneous filling of a batch of cups, for each cup of the batch, a filling unit having a filling cylinder and a filling pipe for a pasty filling product, the filling cylinder containing a filling piston on a product side wherein an air piston is connected to the filling piston by a piston rod on a drive side, and wherein the filling cylinder is closed off above the air piston by a cylinder head connected to a pressure compression reservoir via a compensation pipe, said pressure compensation reservoir supplies nearly constant air pressure to said air piston; said air piston and said filling piston lie on the same vertical axis and move in union corresponding with opening and closing of a closing piston and a filling valve, to thereby together effectively allow said product side of said filling cylinder to be filled with filling product and further drive filling product out of said filling cylinder and said filling pipe.

2. A filling machine as claimed in claim 1, wherein the filling cylinder (23) is designed as a stepped cylinder with a filling-side portion (28) having a smaller diameter for the filling piston (24) and a drive-side portion (29) having a larger diameter for the air piston (31).

3. A filling machine as claimed in claim 2, wherein an additional portion having a larger diameter adjoins the drive-side portion of the filling cylinder and said additional portion receives the air piston during a cleaning phase.

4. A filling machine as claimed in claim 1, wherein, on the drive side, a spindle is arranged on the axis of the filling cylinder, a stop ring for the piston rod is movable on said spindle for adjusting the filling volume.

5. A filling machine as claimed in claim 4, wherein the piston rod is hollow and slidable over the spindle.

6. A filling machine as claimed in claim 4, wherein the filling piston bears with a sealing lip against an internal wall of the filling cylinder.

7. A filling machine as claimed in claim 1, further comprising a product conduit leading into a product chamber of the filling cylinder, said product conduit being able to be shut off by a closing piston.

8. A filling machine as claimed in claim 7, further comprising a filling valve at an outlet of the product chamber in a filling conduit leading to the filling pipe.

9. A filling machine for thermoplastic cups, comprising a cyclically operating conveying section for accepting a cup sheet web with thermoformed cups from a thermoforming station, for simultaneous filling of a batch of cups, for each cup of the batch, a filling unit having a filling cylinder and a filling pipe for a pasty filling product, the filling cylinder containing a filling piston on a product side wherein an air piston is connected to the filling piston by a piston rod on a drive side, and wherein the filling cylinder is closed off above the air piston by a cylinder head connected to a pressure compression reservoir via a compensation pipe, the filling cylinder being designed as a stepped cylinder with a filling-side portion having a smaller diameter for the filling piston and a drive-side portion having a larger diameter for the air piston.

10. A filling machine as claimed in claim 9, wherein an additional portion having a larger diameter adjoins the drive-side portion of the filling cylinder and said additional portion receives the air piston during a cleaning phase.

11. A filling machine as claimed in claim 9, wherein, on the drive side, a spindle is arranged on the axis of the filling cylinder a stop ring for the piston rod is movable on said spindle for adjusting the filling volume.

12. A filling machine as claimed in claim 11, wherein the piston rod is hollow and slidable over the spindle.

13. A filling machine as claimed in claim 11, wherein the filling piston bears with a sealing lip against an internal wall of the filling cylinder.

14. A filling machine as claimed in claim 9, further comprising a product conduit leading into a product chamber of the filling cylinder, said product conduit being able to be shut off by a closing piston.

15. A filling machine as claimed in claim 14, further comprising a filling valve at an outlet of the product chamber in a filling conduit leading to the filling pipe.

16. A filling machine for thermoplastic cups, comprising a cyclically operating conveying section for accepting a cup sheet web with thermoformed cups from a thermoforming station, for simultaneous filling of a batch of cups, for each cup of the batch, a filling unit having a filling cylinder and a filling pipe for a pasty filling product, the filling cylinder containing a filling piston on a product side wherein an air piston is connected to the filling piston by a piston rod on a drive side, and wherein the filling cylinder is closed off above the air piston by a cylinder head connected to a pressure compression reservoir via a compensation pipe, and on the drive side, a spindle is arranged on the axis of the filling cylinder and a stop ring for the piston rod is movable on said spindle for adjusting the filling volume.

17. A filling machine as claimed in claim 16, wherein an additional portion having a larger diameter adjoins the drive-side portion of the filling cylinder and said additional portion receives the air piston during a cleaning phase.

18. A filling machine as claimed in claim 16, wherein the piston rod is hollow and slidable over the spindle.

19. A filling machine as claimed in claim 16, wherein the filling piston bears with a sealing lip against an internal wall of the filling cylinder.

20. A filling machine as claimed in claim 16, further comprising a product conduit leading into a product chamber of the filling cylinder, said product conduit being able to be shut off by a closing piston.

21. A filling machine as claimed in claim 16, further comprising a filling valve at an outlet of the product chamber in a filling conduit leading to the filling pipe.

* * * * *